US009431739B2

(12) United States Patent
Fukushima et al.

(10) Patent No.: US 9,431,739 B2
(45) Date of Patent: Aug. 30, 2016

(54) CONDUCTIVE TERMINAL WITH INSULATING LEADING-END

(71) Applicant: YAZAKI CORPORATION, Minato-ku, Tokyo (JP)

(72) Inventors: Hirotaka Fukushima, Shizuoka (JP); Tsutomu Sawada, Shizuoka (JP); Takashi Tsukamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/428,005

(22) PCT Filed: Sep. 17, 2013

(86) PCT No.: PCT/JP2013/075028
§ 371 (c)(1),
(2) Date: Mar. 13, 2015

(87) PCT Pub. No.: WO2014/046085
PCT Pub. Date: Mar. 27, 2014

(65) Prior Publication Data

US 2015/0229054 A1 Aug. 13, 2015

(30) Foreign Application Priority Data

Sep. 24, 2012 (JP) ..... 2012-209201

(51) Int. Cl.
*H01R 9/24* (2006.01)
*H01R 13/05* (2006.01)
(Continued)

(52) U.S. Cl.
CPC ..... *H01R 13/05* (2013.01); *H01R 13/04* (2013.01); *H01R 13/44* (2013.01); *H01R 4/184* (2013.01)

(58) Field of Classification Search
CPC ..... H01R 13/05; H01R 13/04; H01R 13/44; H01R 4/184
USPC ..... 439/891
See application file for complete search history.

(56) References Cited

U.S. PATENT DOCUMENTS 5,399,110 A * 3/1995 Morello ..... H01R 4/185 439/879
5,558,533 A 9/1996 Hashizawa et al.
(Continued)

FOREIGN PATENT DOCUMENTS

DE 202009017314 U1 3/2010
EP 0951099 A2 10/1999
(Continued)

OTHER PUBLICATIONS

Extended European search report issued on Apr. 8, 2016 in the counterpart European patent application.
(Continued)

*Primary Examiner* — Tulsidas C Patel
*Assistant Examiner* — Peter G Leigh
(74) *Attorney, Agent, or Firm* — Mots Law, PLLC

(57) ABSTRACT

A terminal includes an insulating leading-end insulation portion (8) that is fixed to a conductive terminal main body (7) and that protrudes in front of a leading end of a terminal contact portion (72). The terminal contact portion (72) is formed in a cylindrical shape including a rod through-hole (71) penetrating in an axial direction, and the leading-end insulation portion (8) is formed as a part of an insulation member (82) including a penetrating rod portion (81) penetrating through the rod through-hole (71) and protruding to a back end side of the rod through-hole (71); and the leading-end insulation portion (8) and the back end side of the penetrating rod portion (81) are respectively engaged with respect to the terminal main body (7) in a removal direction to thereby fix the insulation member (82) into the terminal main body (7).

10 Claims, 5 Drawing Sheets

(51) Int. Cl.

| | |
|---|---|
| ***H01R 13/04*** | (2006.01) |
| ***H01R 13/44*** | (2006.01) |
| *H01R 4/18* | (2006.01) |

(56) References Cited

U.S. PATENT DOCUMENTS

| | | | | | |
|---|---|---|---|---|---|
| 5,573,417 | A | | 11/1996 | Hashizawa et al. | |
| 5,674,086 | A | | 10/1997 | Hashizawa et al. | |
| 5,888,107 | A | * | 3/1999 | Seymour | H01R 13/04 439/866 |
| 6,113,436 | A | * | 9/2000 | Kuwahara | H01R 13/44 439/693 |
| 6,146,211 | A | * | 11/2000 | Okamoto | H01R 13/04 439/181 |
| 6,607,399 | B2 | * | 8/2003 | Endo | H01R 4/184 439/578 |
| 8,123,549 | B2 | * | 2/2012 | Jazowski | H02G 3/22 439/426 |
| 8,398,442 | B2 | * | 3/2013 | Yagi | H01R 13/04 439/181 |
| 8,708,719 | B2 | * | 4/2014 | Iihoshi | H01R 13/434 439/131 |
| 9,054,437 | B2 | * | 6/2015 | Kojima | H01R 13/04 |
| 2004/0127108 | A1 | * | 7/2004 | Ferre Giro | H01R 13/055 439/891 |
| 2012/0009828 | A1 | | 1/2012 | Yagi et al. | |
| 2014/0087607 | A1 | * | 3/2014 | Kojima | H01R 13/04 439/891 |

FOREIGN PATENT DOCUMENTS

| | | | |
|---|---|---|---|
| JP | S50-18995 | | 3/1975 |
| JP | H10-213093 | A | 8/1998 |
| JP | H10-275653 | A | 10/1998 |
| JP | 2000-003750 | A | 1/2000 |
| JP | 2000-150040 | A | 5/2000 |
| JP | 2006-339167 | A | 12/2006 |
| JP | 2008-022655 | A | 1/2008 |
| WO | 2011/030712 | A1 | 3/2011 |

OTHER PUBLICATIONS

Japanese Office Action issued on May 10, 2016 in the counterpart Japanese patent application.

* cited by examiner (a)

(b)

(a)

(b)

CONDUCTIVE TERMINAL WITH INSULATING LEADING-END

TECHNICAL FIELD

The present invention relates to a terminal including an insulation portion at its leading end.

BACKGROUND ART

An electric vehicle mounts a charge inlet apparatus that is connected with a charge connecter on a charge stand side or the like to be charged (refer to the patent literature 1, for example). A male terminal is built in the charge inlet apparatus.

FIG. 5(*a*) and FIG. 5(*b*) illustrate a male terminal 100 of prior art. The male terminal 100 includes a conductive terminal main body 110 including a terminal contact portion 111 to be in contact with a mating terminal (not illustrated), and an insulating leading-end insulation portion 120 (formed of resin) fixed to the terminal main body 110 and provided at a leading end of the terminal contact portion 111. At the leading end of the terminal contact portion 111, a constricted portion 112 and a flange portion 113 which are extended forward are protrusively provided. At the leading-end insulation portion 120, a through-hole having a step 121 penetrating in an axis direction is provided. At a back end side of the leading-end insulation portion 120, an engagement portion 122 to be engaged with the constricted portion 112 is formed.

According to the above-described configuration, in assembling the male terminal 100, the flange portion 113 protruding forward from the leading end of the terminal contact portion 111 of the terminal main body 110 is inserted into the through-hole 121 having a step of the leading-end insulation portion 120, and also the constricted portion 112 is engaged with the engagement portion 122 at the back end side of the leading-end insulation portion 120 and thus the leading-end insulation portion 120 is fixed to the terminal main body 110. With this arrangement, the insulating leading-end insulation portion 120 can prevent a user's hand from coming into direct contact with a conductive portion of the male terminal 100.

CITATION LIST

Patent Literature

Patent Literature 1: Japanese Patent Laid-Open Publication No. 10-275653

SUMMARY OF INVENTION

Technical Problem

However, according to the above-described example of the prior art, since engagement strength between the constricted portion 112 of the terminal main body 110 and the engagement portion 122 of the leading-end insulation portion 120 needs to be secured, both the terminal main body 110 and the leading-end insulation portion 120 require high production accuracy. As a result, it becomes difficult to reduce a manufacturing cost. Particularly, the constricted portion 112 of the terminal main body 110 needs to be produced by cutting processing, and it is difficult to perform the cutting processing of a small shape. Accordingly, it is difficult to reduce a size of the male terminal 100.

Therefore, the present invention has been made in order to solve the above-described problems, and objects of the present invention are to provide the terminal capable of enhancing the strength for retaining the leading-end insulation portion by the terminal main body and also capable of reducing the costs.

Solution to Problem

According to an aspect of the present invention, a terminal includes a conductive terminal main body including a terminal contact portion to be in contact with a mating terminal; and an insulating leading-end insulation portion that is fixed to the terminal main body and that protrudes in front of a leading end of the terminal contact portion, wherein the terminal contact portion includes a rod through-hole penetrating in an axial direction; the leading-end insulation portion is formed as a part of an insulation member including a penetrating rod portion penetrating through the rod through-hole and protruding to a back end side of the rod through-hole; and the leading-end insulation portion and the back end side of the penetrating rod portion are respectively engaged with respect to the terminal main body in a removal direction to thereby fix the insulation member to the terminal main body.

It is preferable that the leading-end insulation portion be formed to have a diameter larger than that of the rod through-hole to be engaged with the terminal main body, and the back end side of the penetrating rod portion be formed to have a diameter larger than that of the rod through-hole to thereby be engaged with the terminal main body.

It is preferable that the leading-end insulation portion be formed to have a diameter larger than that of the rod through-hole to thereby be engaged with the terminal main body, and that the terminal main body be bitten into the back end side of the penetrating rod portion and thus the back end side thereof is engaged with the terminal main body.

DESCRIPTION OF EMBODIMENTS

Hereinafter, an embodiment of the present invention will be described with reference to drawings.

Figure 1:
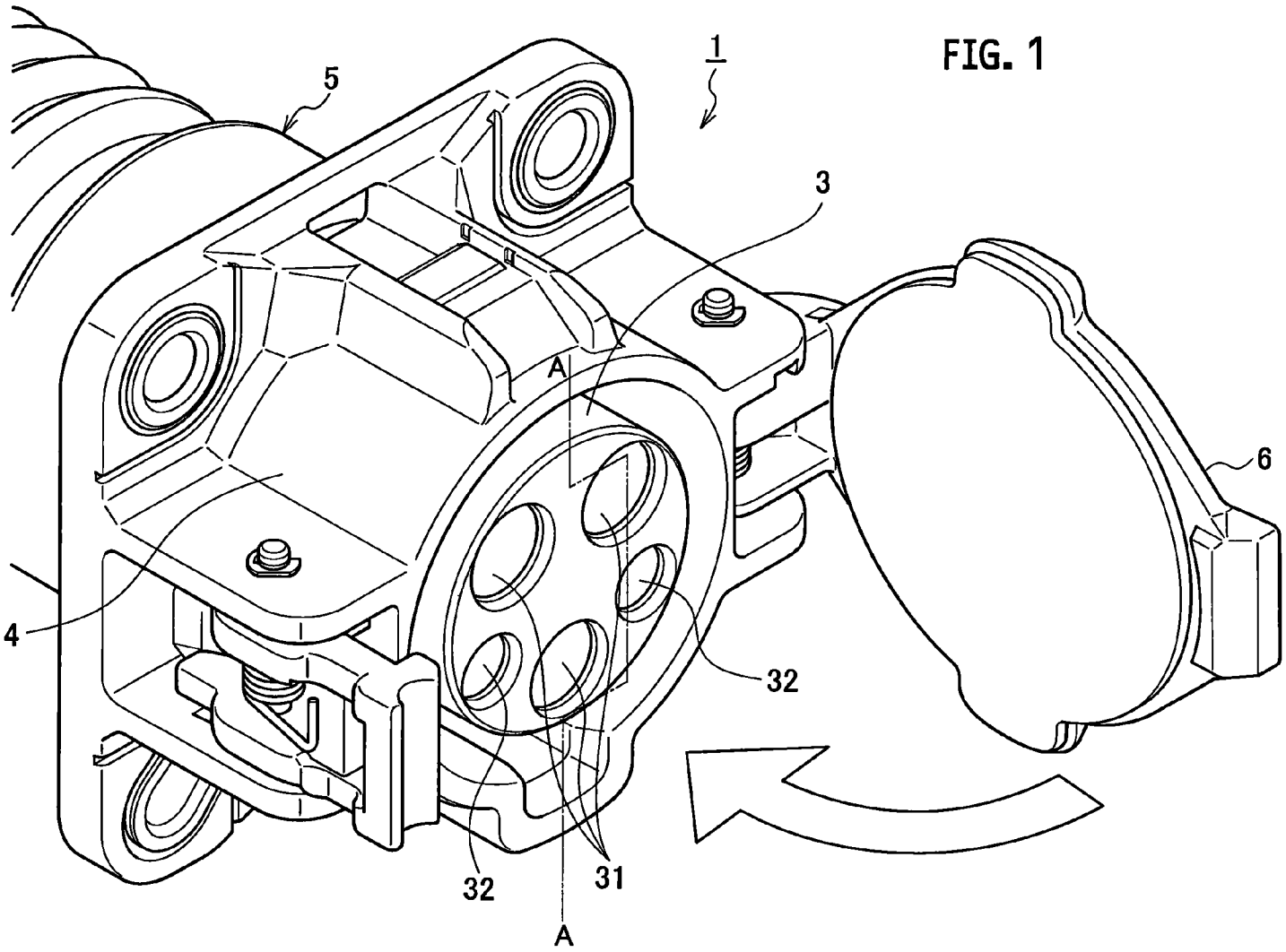
FIG. 1 illustrates an embodiment of the present invention, and is a perspective view illustrating a charge inlet apparatus including a male terminal.
Figure 2:
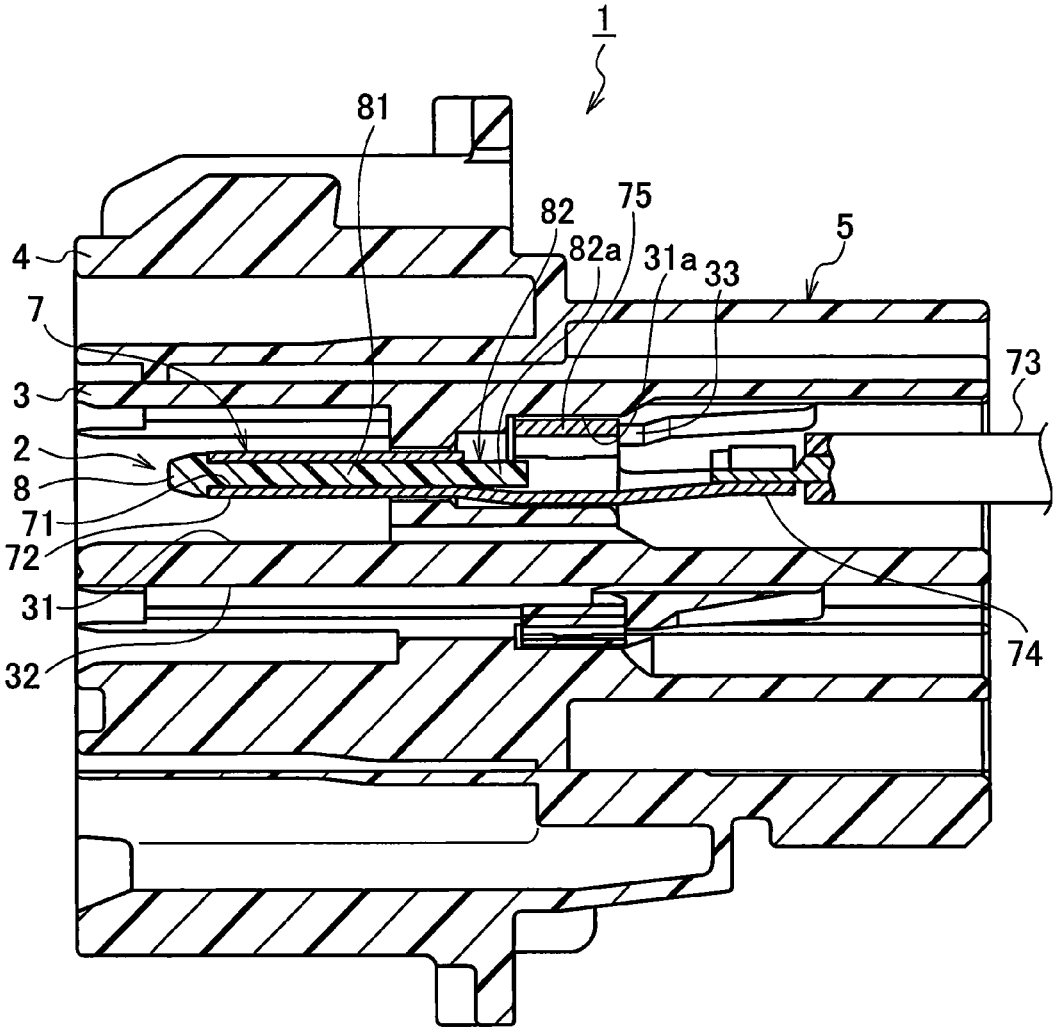
FIG. 2 illustrates an embodiment of the present invention, and is a cross-sectional view taken along the line A-A illustrated in FIG. 1.

FIG. 1 to FIG. 4 illustrate an embodiment of the present invention. A charge inlet apparatus 1 illustrated in FIG. 1 and FIG. 2 is mounted on a vehicle body (not illustrated). The charge inlet apparatus 1 is connected with a charge connecter on a charge stand side or the like (not illustrated) to thereby be charged.

The charge inlet apparatus 1 includes a connector housing portion 3 storing a male terminal 2 that is a terminal, and a housing 5 including an inlet housing portion 4 for covering an outer circumference of the connector housing portion 3. A cap 6 is mounted at an opening portion of the inlet housing portion 4 to be freely opened/closed.

The connector housing portion 3 is provided with three terminal storage holes 31 having a large diameter, which store the male terminal 2 for receiving power, respectively, and two terminal storage holes 32 having a small diameter, which store the male terminal (not illustrated) for detecting a signal, respectively.

Figure 3:
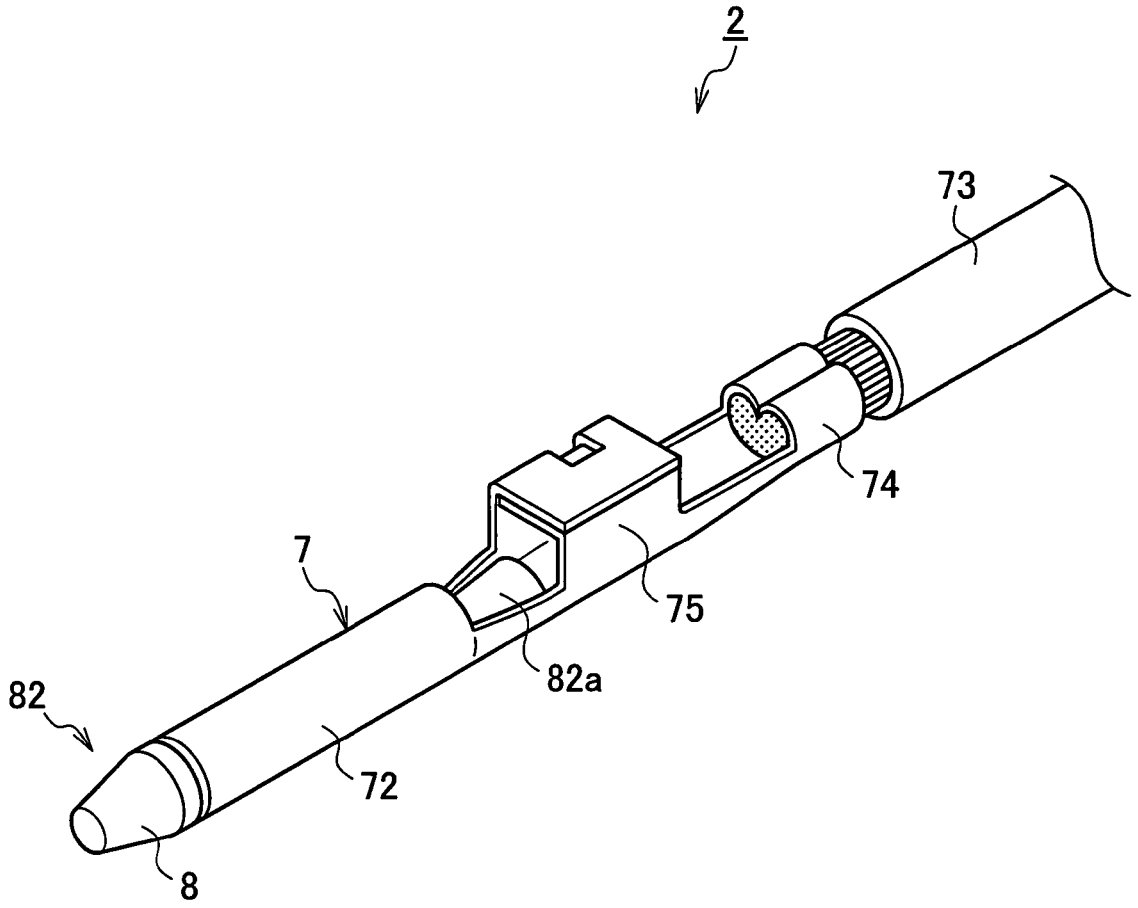
FIG. 3 illustrates an embodiment of the present invention, and is a perspective view of the male terminal.
Figure 4:
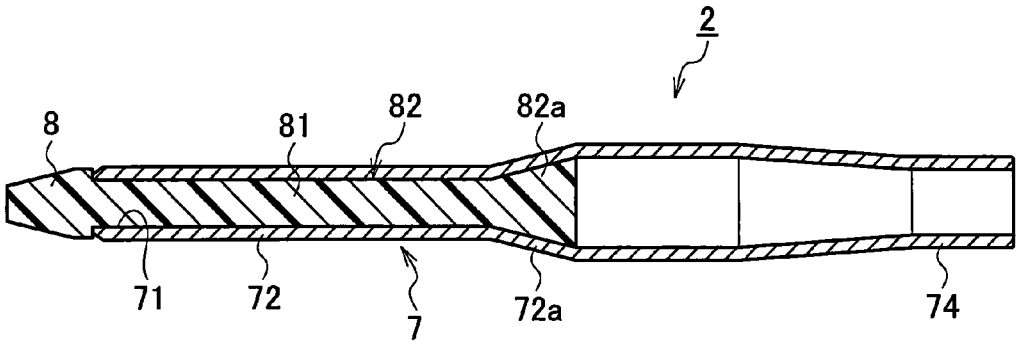
FIG. 4(*a*) and FIG. 4(*b*) illustrate an embodiment of the present invention; in which FIG. 4(*a*) is a cross-sectional view of the completed male terminal, and FIG. 4(*b*) is a cross-sectional view of the male terminal in a state where an insulation member is inserted into the terminal main body.
Figure 4:
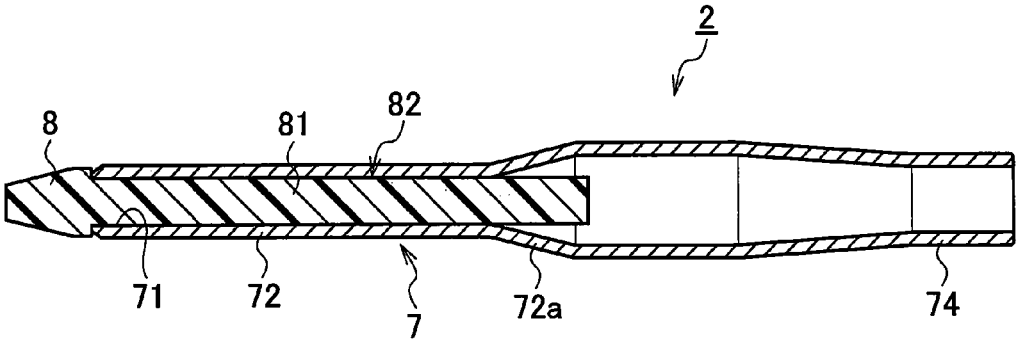
Figure 5:
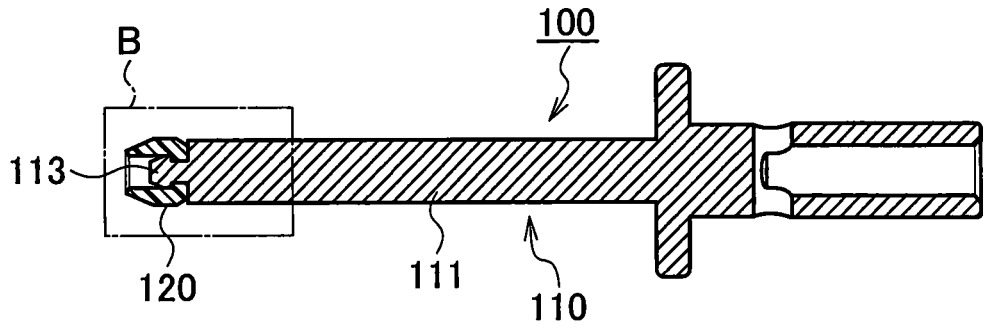
FIG. 5(*a*) and FIG. 5(*b*) illustrate an example of the prior art; in which FIG. 5(*a*) is a cross sectional view of the terminal, and FIG. 5(*b*) is an enlarged cross-sectional view of the "B" part illustrated in FIG. 5(*a*).
Figure 5:
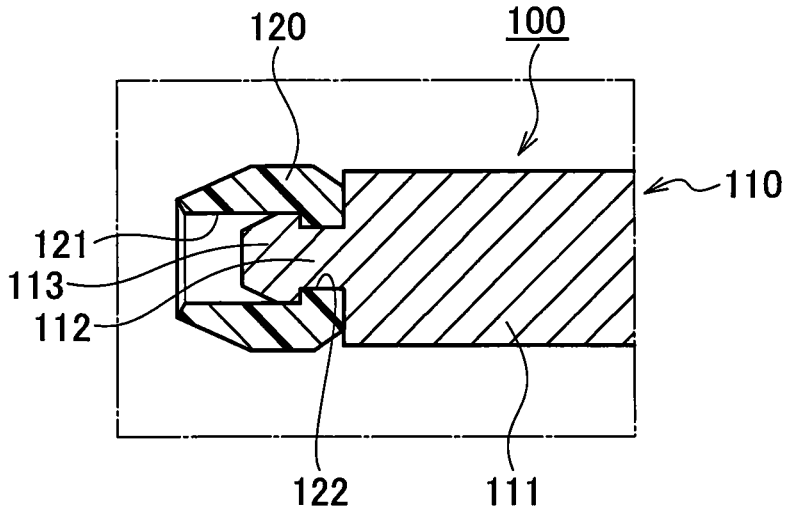

As illustrated in FIG. 2 to FIG. 4, the male terminal 2 includes the conductive terminal main body 7, and an insulating leading-end insulation portion 8 that is fixed to the terminal main body 7 and that protrudes in front of the leading end of the terminal contact portion 72 described below.

The terminal main body 7 is formed by folding a conductive plate in a predetermined shape through press processing. The terminal main body 7 includes a terminal contact portion 72 formed in a cylindrical shape, including a rod through-hole 71 penetrating in an axis direction, and coming into contact with the mating terminal (not illustrated), a wire connection portion 74 connected to a wire 73, and a box-shaped portion 75 provided between the terminal contact portion 72 and the wire connection portion 74. The box-shaped portion 75 is stored in a box storage portion 31*a* (not illustrated) of terminal storage holes 31 and 32 of the connector housing portion 3 to thereby stop rotation so that the male terminal 2 does not rotate in the connector housing portion 3, and also a back end of the box-shaped portion 75 is engaged with a lance 33 at a connector housing portion 3 side in order to prevent the male terminal 2 from slipping off.

An insulation member 82 is formed of an insulating member, which is, for example, a synthetic resin material. The insulation member 82 is constituted of the leading-end insulation portion 8 protruding in front of the leading end of the terminal contact portion 72, and a penetrating rod portion 81 penetrating through the rod through-hole 71 of the terminal contact portion 72 to protrude to the back end side of the rod through-hole 71. More specifically, the leading-end insulation portion 8 is formed as a part of the insulation member 82 including the penetrating rod portion 81.

The leading-end insulation portion 8 is formed to have the same diameter dimension as that of an outer face of the terminal contact portion 72, or have a slightly smaller diameter dimension than that of an outer face of the terminal contact portion 72 and also to have a larger diameter dimension than that of an inner face of the terminal contact portion 72. With this arrangement, in a state where a back end face of the leading-end insulation portion 8 is abutted on a front end face of the penetrating rod portion 81, the leading-end insulation portion 8 and the penetrating rod portion 81 are integrally molded as the insulation member 82.

The leading-end insulation portion 8 is formed to have the same diameter dimension as that of the outer face of the terminal contact portion 72, or have a slightly smaller diameter dimension than that of the outer face of the terminal contact portion 72 and also to have a larger diameter dimension than that of an inner face of the terminal contact portion 72, and thus a portion that is not abutted on the penetrating rod portion 81 of the back end face of the leading-end insulation portion 8 is abutted on the front end face of the terminal contact portion 72.

The penetrating rod portion 81 is formed to have a slightly smaller diameter dimension than that of the inner face of the terminal contact portion 72. A slipping-off stop portion 82*a* having a diameter larger than that of the rod through-hole 71 is formed through thermal fusion or the like, at the back end side of the penetrating rod portion 81. The leading-end insulation portion 8 of the insulation member 82 is engaged with the leading end of the terminal contact portion 72 in an insertion direction (right direction illustrated in FIG. 2), and also the leading-end insulation portion 8 and the back end side of the penetrating rod portion 81 are each engaged with respect to the terminal main body 7 in a removal direction (left direction illustrated in FIG. 2), and thus the insulation member 82 is fixed to the terminal main body 7.

Next, a procedure for assembling the male terminal 2 will be described. First, the conductive plate is cut into a predetermined shape, and the press processing for folding the conductive plate into a predetermined shape is performed to manufacture the terminal main body 7. Next, as illustrated in FIG. 4(*b*), the penetrating rod portion 81 of the insulation member 82 is inserted into the rod through-hole 71 of the terminal contact portion 72 from the front, and thus the leading-end insulation portion 8 is abutted on the leading end of the terminal contact portion 72. With this arrangement, since the leading-end insulation portion 8 has a diameter larger than that of the rod through-hole 71, with the arrangement described above, the leading-end insulation portion 8 is engaged with the leading end of the terminal contact portion 72 in the insertion direction (right direction illustrated in FIG. 2).

Next, as illustrated in FIG. 4(*a*), the back end portion of the penetrating rod portion 81 is deformed by the thermal fusion, and the back end portion of the penetrating rod portion 81 is expanded according to a shape of the extended diameter portion 72*a* of the terminal main body 7 in a diameter direction to form the slipping-off stop portion 82*a* of the insulation member 82. With this arrangement, since the slipping-off stop portion 82*a* of the insulation member 82 has a diameter larger than that of the rod through-hole 71, the leading-end insulation portion 8 and the back end side of the penetrating rod portion 81 are each engaged with respect to the terminal main body 7 in the removal direction (left direction illustrated in FIG. 2), and thus the insulation member 82 is fixed to the terminal main body 7.

According to the above-described configuration, when a user inserts his/her finger and the like into the terminal storage holes 31 and 32, the user's finger and the like comes into contact with the leading-end insulation portion 8, but the finger and the like can be prevented from coming into direct contact with the terminal main body 7 that is the conductive member placed on the inner side.

As described above, the conductive terminal main body 7 includes the terminal contact portion 72 to be in contact with the mating terminal (not illustrated), and the terminal contact portion 72 is formed in a cylindrical shape including the rod through-hole 71 penetrating in the axis direction. The insulating leading-end insulation portion 8 protruding in front of the leading end of the terminal contact portion 72 is formed as a part of an insulation member 82 including the penetrating rod portion 81 penetrating through the rod through-hole 71 and protruding to the back end side of the rod through-hole 71. The leading-end insulation portion 8 is engaged with respect to the terminal main body 7 in the removal direction, and at the same time, the back end side of the penetrating rod portion 81 is engaged with respect to the terminal main body 7 in the removal direction and the insulation member 82 is fixed to the terminal main body 7. Therefore, unlike the prior art, since no constricted portion of the terminal main body and no engagement portion of the leading-end insulation portion need to be provided, both the terminal main body 7 and the leading-end insulation portion 8 require high production accuracy, and the terminal main body 7 can be produced though the press processing, thereby capable of reducing the costs.

Unlike the prior art, since no fragile portions such as the constricted portion and the engagement portion need to be provided in order to fix the leading-end insulation portion to the terminal main body, the strength for retaining the leading-end insulation portion 8 by the terminal main body 7 can be enhanced.

A material having a small shape can be processed by production of the terminal main body 7 through the press processing, and thus the reduction of the size of the male terminal 2 can be achieved.

Note that, according to the above-described embodiment, an example is described in which the charge inlet apparatus 1 is provided with the male terminal 2, but the present invention is not limited thereto, and can be applied to terminals for high voltage, other than these.

According to the above-described embodiment, the extended diameter portion 72*a* having a diameter larger than that of the rod through-hole 71 is formed by deformation of the back end portion of the penetrating rod portion 81 through the thermal fusion, but processing other than the thermal fusion may be used. For example, the back end portion of the penetrating rod portion 81 can also be formed to have a diameter larger than that of the rod through-hole 71 by swaging and deforming the back end portion.

Further, as described above, instead of swaging and deforming the back end portion of the penetrating rod portion 81, the terminal main body is swaged and deformed and the terminal main body bites into the back end side of the penetrating rod portion 81, and thus the back end side of the penetrating rod portion can be engaged with the terminal main body.

The present application claims the priority based on Japanese Patent Application No. 2012-209201 filed on the 24 Sep. 2012, and the entire content of the application is incorporated in the present specification as a reference.

INDUSTRIAL APPLICABILITY

According to the present invention, in assembling the leading-end insulation portion to the terminal main body, the penetrating rod portion of the insulating member is inserted into the rod through-hole of the terminal contact portion to protrude to the back end side of the rod through-hole, and also the leading-end insulation portion and the back end side of the penetrating rod portion are respectively engaged with respect to the terminal main body in the removal direction to thereby fix the insulation member to the terminal main body. With this arrangement, unlike the priority art, no constricted portion of the terminal main body and no engagement portion of the leading-end insulation portion need to be provided, and the terminal main body and the leading-end insulation portion do not require high production accuracy. Therefore, the terminal main body can be produced by the press processing, thereby capable of reducing the costs. In addition, unlike the prior art, in order to fix the leading-end insulation portion to the terminal main body, no fragile portions such as the constricted portion and the engagement portion needs to be provided, and thus the strength for retaining the leading-end insulation portion by the terminal main body can be enhanced.

REFERENCE SIGNS LIST

2 male terminal (terminal)
7 terminal main body
8 leading-end insulation portion
71 rod through-hole
72 terminal contact portion
81 penetrating rod portion
82 insulation member

The invention claimed is:

1. A terminal, comprising:

a conductive terminal main body including a terminal contact portion to be in contact with a mating terminal; and an insulating leading-end insulation portion that is fixed to the terminal main body and that protrudes in front of a leading end of the terminal contact portion, wherein the terminal contact portion is formed in a cylindrical shape including a rod through-hole penetrating in an axial direction and an extended diameter portion at a back end side of the rod through-hole, the extended diameter portion having a diameter larger than that of the rod through-hole;

the leading-end insulation portion is formed as a part of an insulation member including a penetrating rod portion penetrating through the rod through-hole and protruding to the back end side of the rod through-hole, a back end portion of the penetrating rod portion at the back-end side of the rod through-hole expanded according to a shape of the extended diameter portion; and the leading-end insulation portion and an outer surface of the back end side of the penetrating rod portion are respectively engaged with respect to the terminal main body in a removal direction to thereby fix the insulation member to the terminal main body.

2. The terminal according to claim 1, wherein the leading-end insulation portion is formed to have a diameter larger than a diameter of the rod through-hole to thereby be engaged with the terminal main body; and the back end side of the penetrating rod portion is formed to have a diameter larger than a diameter of the rod through-hole to thereby be engaged with the terminal main body.

3. The terminal according to claim 1, wherein the leading-end insulation portion is formed to have a diameter larger than a diameter of the rod through-hole to thereby be engaged with the terminal main body; and the back end side of the penetrating rod portion is bitten into by the terminal main body to thereby be engaged with the terminal main body.

4. The terminal according to claim 1, wherein the leading-end insulation portion is formed to have a diameter the same as a diameter of an outer face of the terminal contact portion.

5. The terminal according to claim 1, wherein the leading-end insulation portion is formed to have a diameter smaller than a diameter of an outer face of the terminal contact portion.

6. The terminal according to claim 1, wherein the leading-end insulation portion is formed to have a diameter larger than a diameter of an inner face of the terminal contact portion.

7. The terminal according to claim 1, wherein a back end face of the leading-end insulation portion is abutted on a front end face of the penetrating rod portion such that the leading-end insulation portion and the penetrating rod portion are integrally molded as the insulation member.

8. The terminal according to claim 1, wherein the leading-end insulation portion is formed to have a diameter at least one of: the same as that of the outer face of the terminal contact portion; smaller than that of the outer face of the terminal contact portion; and larger than that of an inner face of the terminal contact portion such that a portion that is not abutted on the penetrating rod portion of a back end face of the leading-end insulation portion is abutted on a front end face of the terminal contact portion.

9. The terminal according to claim 1, wherein the penetrating rod portion is formed to have a smaller diameter dimension than that of the inner face of the terminal contact portion such that a slipping-off stop portion having a diameter larger than that of the rod through-hole is fanned through thermal fusion at the back end side of the penetrating rod portion.

10. The terminal according to claim 1, wherein the leading-end insulation portion of the insulation member is engaged with the leading end of the terminal contact portion in an insertion direction.

* * * * *